US007492331B2

(12) United States Patent
Chae et al.

(10) Patent No.: US 7,492,331 B2
(45) Date of Patent: Feb. 17, 2009

(54) PLASMA DISPLAY PANEL AND DRIVING METHOD THEREFOR

(75) Inventors: Seung-Hun Chae, Suwon-si (KR); Woo-Joon Chung, Asan-si (KR); Jin-Sung Kim, Cheonan-si (KR); Kyoung-Ho Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 472 days.

(21) Appl. No.: 10/896,012

(22) Filed: Jul. 22, 2004

(65) Prior Publication Data

US 2005/0052354 A1 Mar. 10, 2005

(30) Foreign Application Priority Data

Jul. 25, 2003 (KR) ..... 10-2003-0051386

(51) Int. Cl.
*G09G 3/28* (2006.01)

(52) U.S. Cl. ..... 345/60

(58) Field of Classification Search ..... 345/37, 345/41, 52, 55, 60–69, 94, 208, 210
See application file for complete search history.

(56) References Cited

U.S. PATENT DOCUMENTS 5,745,086 A 4/1998 Weber ..... 345/63
2002/0008680 A1* 1/2002 Hashimoto et al. ..... 345/63
2002/0033675 A1* 3/2002 Kang et al. ..... 315/169.1
2002/0140639 A1* 10/2002 Sakita ..... 345/60
2003/0117384 A1* 6/2003 Lee et al. ..... 345/204
2006/0092103 A1* 5/2006 Kim ..... 345/60

* cited by examiner

*Primary Examiner*—Amr Awad
*Assistant Examiner*—Dennis P Joseph
(74) *Attorney, Agent, or Firm*—H.C. Park & Associates, PLC

(57) ABSTRACT

Apparatus and method for a plasma display panel (PDP) for controlling power on external video data and generating power control data into N subfields to represent grays is provided having a plasma panel including a plurality of address electrodes, scan electrodes and sustain electrodes arranged in pairs with the address electrodes, a controller for performing power control on the video data to generate N subfields, generating subfield data and sustain pulse information corresponding to the respective subfields, and outputting a floating control signal for controlling a floating time according to the sustain pulse information, an address data driver for applying a voltage that corresponds to the subfield data to the address electrode, a sustain electrode driver for applying a voltage to the sustain electrode according to the sustain pulse information output by the controller, and a scan electrode driver for controlling the floating time according to the floating control signal, and applying a voltage to the scan electrode according to the sustain pulse information.

9 Claims, 6 Drawing Sheets

PLASMA DISPLAY PANEL AND DRIVING METHOD THEREFOR

CROSS-REFERENCE TO RELATED APPLICATIONS

This application claims priority of Korean Patent Application No. 2003-51386, filed on Jul. 25, 2003, in the Korean Intellectual Property Office, which hereby is incorporated by reference.

BACKGROUND OF THE INVENTION (1) Field of the Invention

The present invention relates to a plasma display panel (PDP) and a method for driving a PDP.

(2) Description of the Related Art

A plasma display panel (PDP) is a flat panel display that uses plasma generated via a gas discharge process to display characters or images. Tens to millions of pixels are provided in a matrix format on a PDP, depending on the size of the PDP. PDPs are categorized into DC PDPs and AC PDPs, according to supplied driving voltage waveforms and discharge cell structures.

Typically, the AC PDP driving method uses a reset period, an address period, and a sustain period with respect to temporal operation variations. During the reset period, wall charges formed by a previous sustain are erased, and cells are reset so as to fluently perform a next address operation. During the address period, cells that are turned on and those that are not turned on are selected, and the wall charges are accumulated on the turned-on cells (i.e., addressed cells). During the sustain period, a discharge for displaying images to the addressed cells is executed. When the sustain period starts, sustain pulses are alternately applied to the scan electrodes and sustain electrodes to thus perform sustaining and display the images.

Conventionally, a ramp waveform is applied to a scan electrode so as to establish wall charges in the reset period, as disclosed in U.S. Pat. No. 5,745,086, which hereby is incorporated by reference. A gradually rising ramp waveform is applied to the scan electrode, and a gradually falling ramp waveform is then applied thereto. Since precision control of the wall charges greatly depends on the slope or gradient of the ramp in applying the ramp waveforms, the wall charges are not finely controlled within a predetermined time frame.

SUMMARY OF THE INVENTION

The present invention provides a PDP apparatus and method for precisely controlling wall charges.

According to a first embodiment of the present invention, a plasma display panel (PDP) is provided having at least one address electrode, at least one scan electrode, at least one sustain electrode arranged in a pair with the at least one address electrode, a controller for generating subfield data and sustain pulse information and outputting a floating control signal for controlling a floating time of at least one of the address electrode, the scan electrode and the sustain electrode according to the sustain pulse information, and a driver for applying a voltage that corresponds to subfield data of the at least one address electrode, applying a voltage to the at least one sustain electrode and at least one scan electrode according to sustain pulse information, and floating at least one of the address electrode, the sustain electrode, and the scan electrode according to the floating control signal.

The controller comprises an automatic power controller for outputting power control data to control the power according to a load ratio of the video signal, a subfield generator for generating the power control data into N subfields, and outputting sustain pulse information for each subfield, a subfield data generator for generating the video signals into subfield data that correspond to the subfields and outputting the subfield data, a memory for storing the sustain pulse information and a floating time that corresponds to the sustain pulse information, and a floating controller for referring to the memory and outputting a floating control signal to the scan electrode driver so as to control the floating by using the floating time that corresponds to sustain pulse information of a previous subfield.

According to another embodiment of the present invention, a PDP is provided for generating input video signals into a plurality of subfields, dividing each subfield into a reset period, an address period, and a sustain period according to sustain information, and driving the subfield, said PDP comprising first and second electrodes, a first space defined by the first and second electrodes, and a driving circuit for transmitting a driving signal to the first and second electrodes during the reset period, and wherein the driving circuit applies a first voltage to the first electrode to discharge the first space and float the first electrode, and the floating period (voltage application period) corresponds to sustain information of a previous subfield.

The present invention also provides a method for driving a PDP including a first space defined by first and second electrodes, comprising generating input video signals into N subfields and outputting sustain pulse information of each subfield, applying a first voltage to the first electrode according to the sustain pulse information to discharge the first space, and floating the first electrode for a period that corresponds to sustain pulse information of a previous subfield after discharging the first space.

According to another method of the present invention, a method is provided for driving a PDP including a first space defined by first and second electrodes and a driving circuit for driving the first space by sustain pulses, said method comprising the steps of applying a first voltage to the first electrode to discharge the first space, and floating the first electrode for a period that corresponds to a number of sustain pulses of a previous subfield after discharging the first space.

DETAILED DESCRIPTION OF THE PREFERRED EMBODIMENTS

Figure 1:
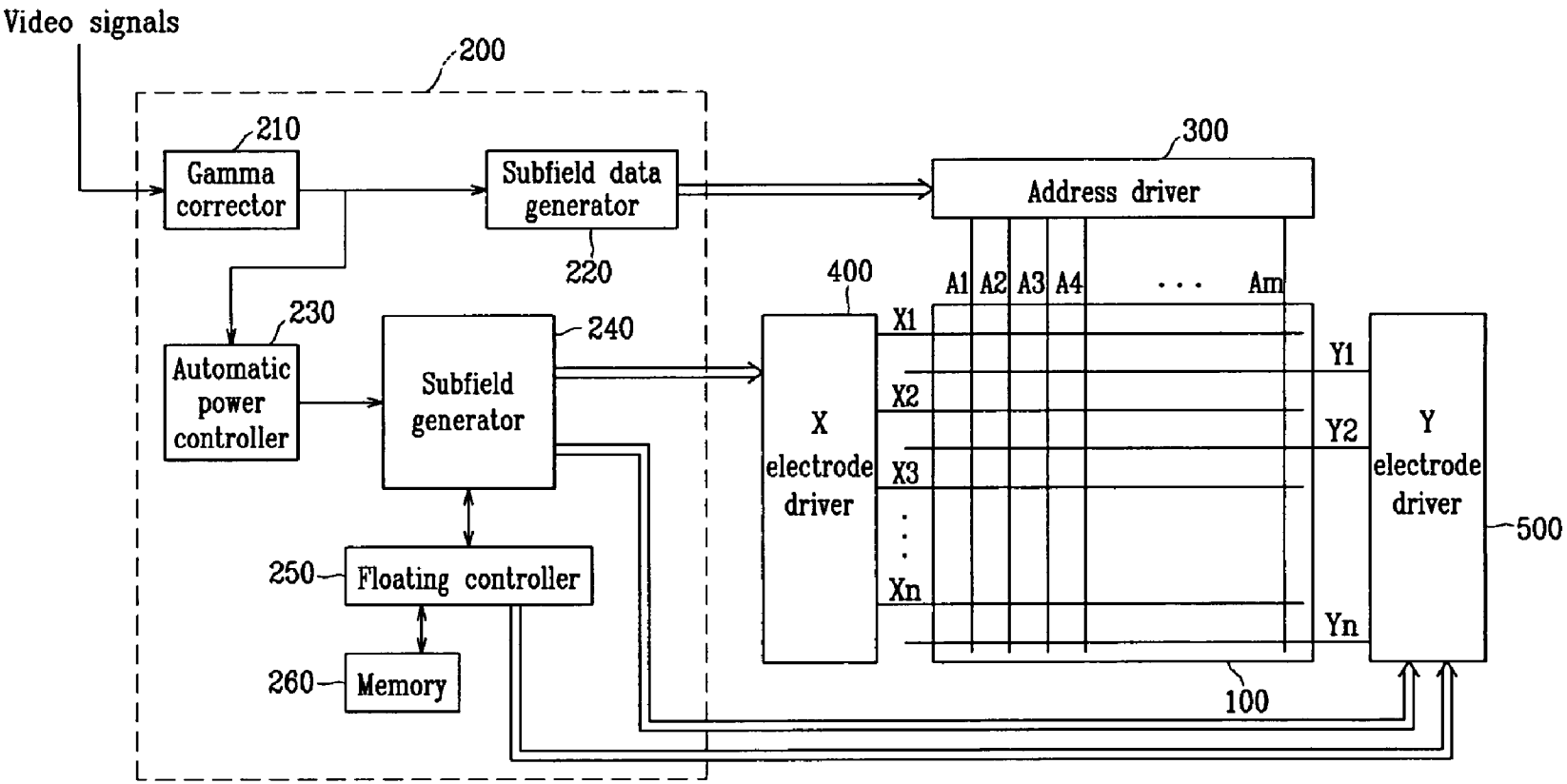
FIG. 1 is a schematic diagram of a plasma display panel (PDP) system configured in accordance with an embodiment of the present invention.

FIG. 1 is a schematic diagram of a PDP system configured in accordance with a preferred embodiment of the present invention. As shown in FIG. 1, the PDP system includes a plasma panel 100, a controller 200, an address driver 300, a sustain electrode driver (referred to as an X electrode driver hereinafter) 400, and a scan electrode driver (referred to as a Y electrode driver hereinafter) 500.

The plasma panel 100 comprises a plurality of address electrodes A1 through Am arranged in the column direction, a plurality of sustain electrodes (referred to as X electrodes hereinafter) X1 through Xn arranged in the row direction, and a plurality of scan electrodes (referred to as Y electrodes hereinafter) Y1 through Yn arranged in the row direction. The X electrodes X1 through Xn are formed corresponding to the respective Y electrodes Y1 through Yn, and the ends of the X electrodes X1 through Xn are coupled in common. The plasma panel 100 includes a glass substrate (not illustrated) on which the X and Y electrodes X1 through Xn and Y1 through Yn are arranged, and a glass substrate (not illustrated) on which the address electrodes A1 through Am are arranged. The two glass substrates face each other with a discharge space in between so that the Y electrodes Y1 through Yn may cross the address electrodes A1 through Am and the X electrodes X1 through Xn may cross the address electrodes A1 through Am. Discharge spaces on the crossing points of the address electrodes A1 through Am and the X and Y electrodes X1 through Xn and Y1 through Yn form discharge cells.

The controller 200 externally receives video signals, and outputs address driving control signals, X electrode driving control signals, and Y electrode driving control signals. Also, the controller 200 divides a single frame into a plurality of subfields and drives them, and each subfield includes a reset period, an address period, and a sustain period with respect to temporal operation variations.

The address driver 300 receives address driving control signals from the controller 200, and applies display data signals for selecting desired discharge cells to the respective address electrodes A1 through Am. The X electrode driver 400 receives X electrode driving control signals from the controller 200, and applies driving voltages to the X electrodes X1 through Xn, and the Y electrode driver 500 receives Y electrode driving control signals from the controller 200, and applies driving voltages to the Y electrodes Y1 through Yn.

The controller 200 comprises a gamma corrector 210, a subfield data generator 220, an automatic power controller 230, a subfield generator 240, a floating controller 250, and a memory 260. The gamma corrector 210 receives video signals, corrects their gamma according to PDP characteristics, and outputs corrected video signals. The automatic power controller 230 measures an average signal level (ASL) of the video data output by the gamma corrector 210, controls power according to the measured ASL, and outputs power control data. The subfield generator 240 generates N subfields from the power control data, and outputs sustain pulse information for each subfield. The subfield data generator 220 generates the video signals into subfield data that correspond to the subfields, and outputs the subfield data. The memory 260 stores the sustain pulse information and floating time that corresponds to the sustain pulse information. The floating controller 250 refers to the memory 260, and outputs a floating control signal to the Y electrode driver 500 so as to control the floating by using the floating time that corresponds to the sustain pulse information of a previous subfield. The function of the floating controller 250 can be included in the function of the subfield generator 240 to drive the Y electrode driver 500.

Referring to FIGS. 2 through 5B, the gamma corrector 210 of the controller 200 receives external video signals, corrects their gamma according to PDP characteristics, and outputs corrected video signals. The automatic power controller 230 measures an ASL of the video data output by the gamma corrector 210, controls power according to the measured ASL, and outputs power control data. The subfield generator 240 generates N subfields from the power control data, and outputs sustain pulse information to the X and Y electrode drivers 400 and 500 for each subfield.

The memory 260 stores the sustain pulse information output by the subfield generator 240 through the floating controller 250. The memory 260 previously stores the floating times that correspond to the number of sustain pulses. An experimental table is stored within the memory 260 so that the floating time may be reduced as the number of sustain pulses is increased. A reset operation generates the optimal wall charge state for the address operation. Time of the floating is controlled depending on the amount of the priming particles. The amounts of the priming particles are determined in proportion to the number of sustain pulses of the previous subfield. Accordingly, the floating time is shortened when the number of sustain pulses of the previous subfield is large, and the floating time is increased as the number of sustain pulses of the previous subfield becomes less, and optimized determination values are stored in the memory 260 in the table format. The above-noted table is realized in a control program format.

The floating controller 250 refers to the memory 260, and outputs a floating control signal to the Y electrode driver 500 so as to control the floating by using the floating time that corresponds to the number of sustain pulses of a previous subfield when a voltage of a scan electrode of a current subfield is applied. The function of the floating controller 250 can be included in the sustain pulse information of the subfield generator 240 to drive the Y electrode driver 500.

The subfield data generator 220 generates the video signals into subfield data that correspond to the subfields, and outputs the subfield data to the address driver 300. The address driver 300 receives the subfield data, and applies display data signals for selecting discharge cells to be displayed to the respective address electrodes A1 to Am.

The X electrode driver 400 receives the sustain pulse information from the subfield generator 240, and applies a driving voltage to the X electrodes X1 to Xn, and the Y electrode driver 500 receives the sustain pulse information, and applies a driving voltage to the Y electrodes Y1 to Yn. The Y electrode driver 500 applies a discharge voltage to the Y electrodes during the reset period, performs floating, and repeats these operations The floating time is determined according to the floating control signal.

The address electrodes A1 to Am, which are arranged in the column direction, and the X and Y electrodes X1 to Xn and Y1 to Yn, which are arranged in the row direction, respectively, receive signals, and then the plasma panel 100 displays corresponding data.

Through the above-described processes, the time allocated to the reset period is reduced since the floating time of the reset period is controlled depending on the number of sustain pulses.

Figure 2:
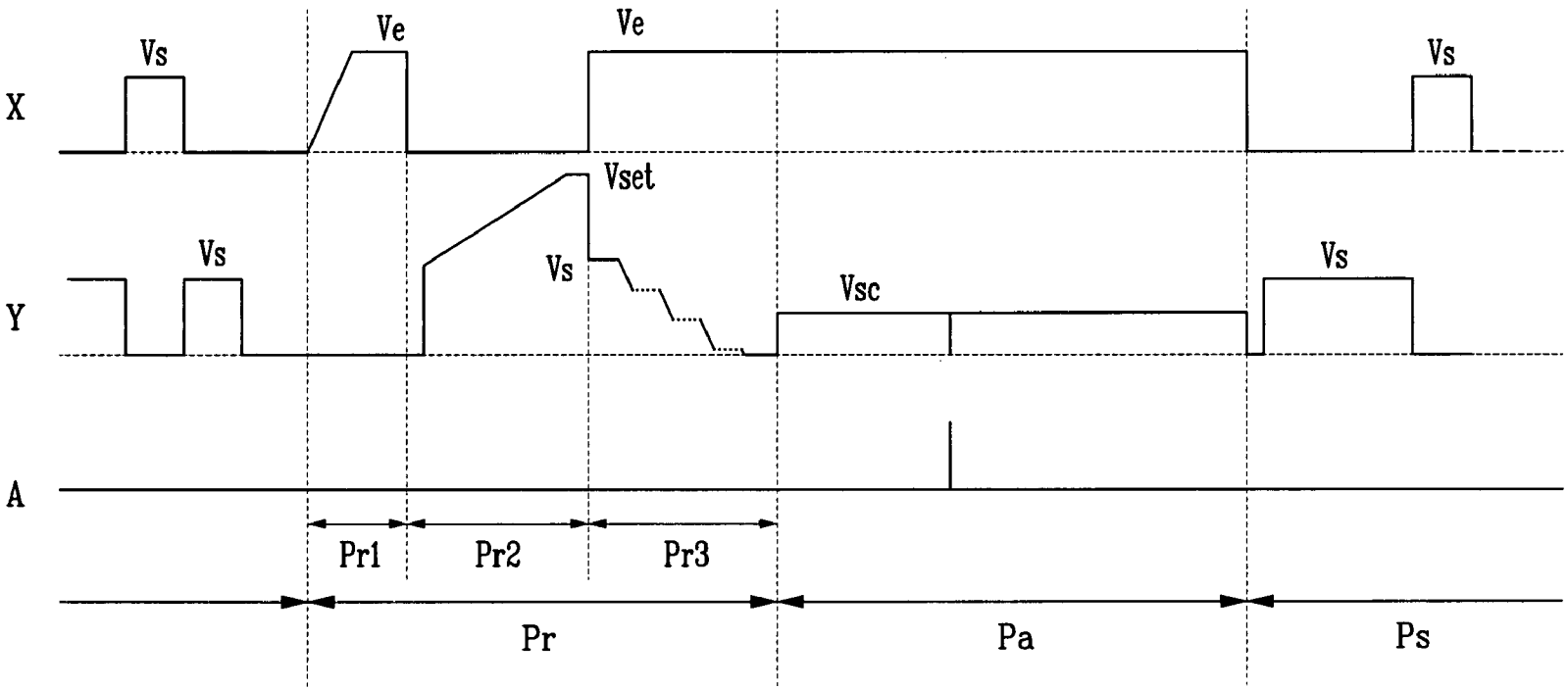
FIG. 2 shows a driving waveform diagram of the PDP in accordance with a preferred embodiment of the present invention.
Figure 3A:
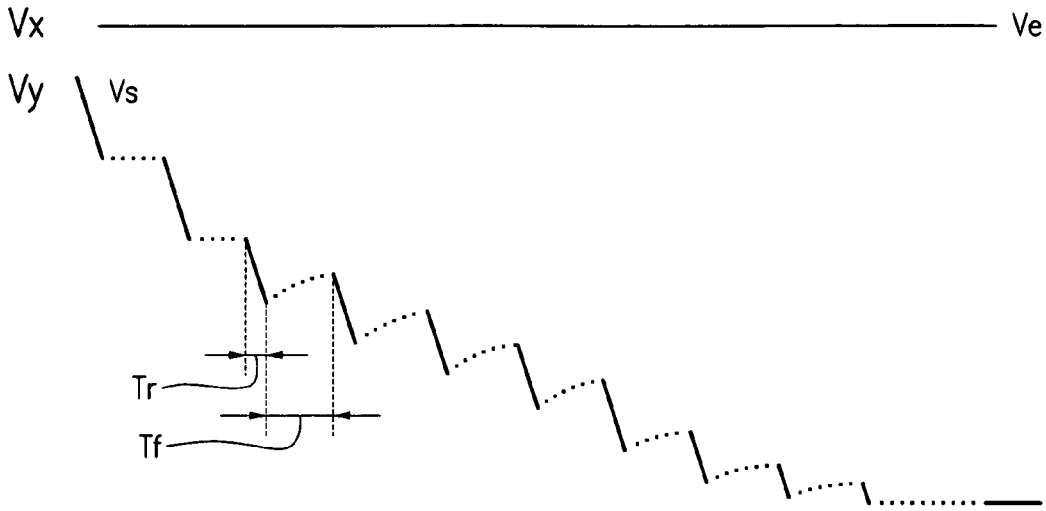
FIGS. 3A and 3B show falling ramp waveforms of floating times in accordance with the present invention.
Figure 3B:
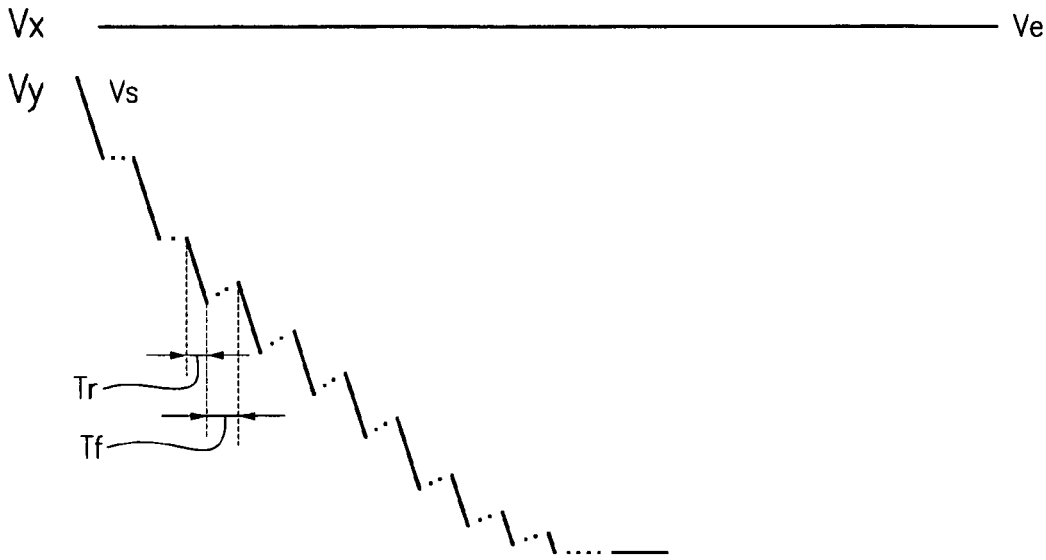

FIG. 2 shows a driving waveform diagram of the PDP in accordance with a preferred embodiment of the present invention. FIGS. 3A and 3B show voltages at the electrodes caused by the driving waveform according to a preferred embodiment of the present invention.

Referring first to FIG. 2, a single subfield includes a reset period Pr, an address period Pa, and a sustain period Ps. The reset period Pr includes an erase period Pr1, a rising ramp period Pr2, and a falling ramp period Pr3. Positive charges are formed at the X electrode, and negative charges are formed at the Y electrode when the last sustaining is finished in a sustain period. A ramp waveform rising from a reference voltage to a voltage of Ve is applied to the X electrode while the Y electrode is maintained at the reference voltage after the sustain period is finished in the erase period Pr1 of the reset period Pr, assuming that the reference voltage is 0V (volts). The charges accumulated at the X and Y electrodes are gradually erased.

Next, a ramp waveform, rising from a voltage of Vs to a voltage of Vset, is applied to the Y electrode, while the X electrode is maintained at 0V in the rising ramp period Pr2 of the reset period Pr. Weak resetting is generated to the address electrode and the X electrode from the Y electrode. Negative charges are accumulated at the Y electrode, and the positive charges are accumulated at the address electrode and the X electrode.

As shown in FIGS. 2, 3A and 3B, a falling/floating voltage for repeating a process, wherein the voltage of Vs is reduced by a predetermined voltage and floated until it reaches the reference voltage, is applied to the Y electrode, while the X electrode is maintained at the voltage of Ve in the falling ramp period Pr3 of the reset period Pr. The voltage applied to the Y electrode is rapidly reduced during the period of Tr, and the voltage applied to the Y electrode is stopped during the period of Tf to thereby float the Y electrode, and the periods Tr and Tf are repeated.

When a voltage difference between the voltage of Vx at the X electrode and the voltage of Vy at the Y electrode becomes greater than a discharge firing voltage Vf, while repeating the periods Tr and Tf, a discharge occurs between the X and Y electrodes. A discharge current Id flows in the discharge space. When the Y electrode is floated after the discharge begins between the X and Y electrodes, the wall charges formed at the X and Y electrodes are reduced, the voltage within the discharge space is steeply reduced, and strong discharge quenching is generated within the discharge space. When a falling voltage is applied to the Y electrode to form a discharge and float the Y electrode, the wall charges are reduced, and strong discharge quenching is generated within the discharge space. When applying the falling voltage and floating the Y electrode are repeated a predetermined number of times, desired amounts of wall charges are formed at the X and Y electrodes.

It is preferable for the falling voltage applying period Tr to be short, so as to appropriately control the wall charges. When the period Tr for applying the voltage is long, the discharge is greatly formed, and the amount of wall charges to be controlled by a single discharge and floating becomes large. When the amount of wall charges to be controlled becomes too large, it may be difficult to adequately control the wall charges.

As described above, the floating time is controlled depending on the number of sustain pulses of the previous subfield, and FIG. 3A shows a case where less priming particles are provided because of the small number of the sustain pulses of the previous subfield, and it is required to increase the floating time so as to fluently perform the reset operation. FIG. 3B shows a case where many priming particles are provided because of the large number of the sustain pulses of the previous subfield, and the reset operation functions well when the floating time is reduced.

Figure 4A:
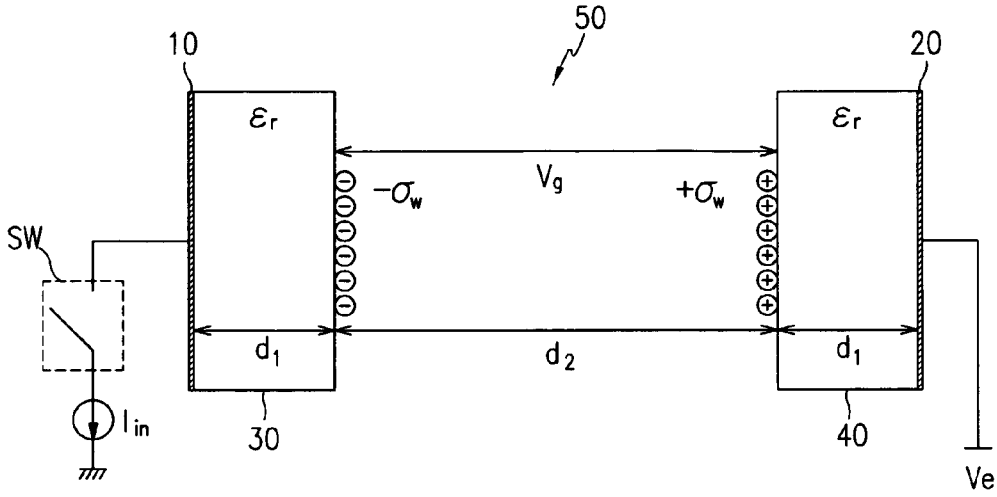
FIG. 4A shows a modeled diagram of a discharge cell formed by a sustain electrode and a scan electrode in accordance with the present invention.
Figure 4B:
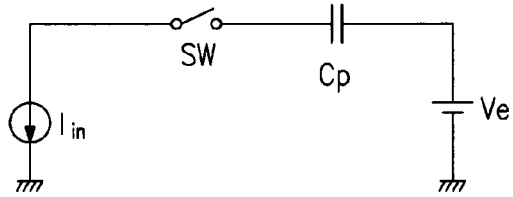
FIG. 4B shows an equivalent circuit of FIG. 4A.
Figure 4C:
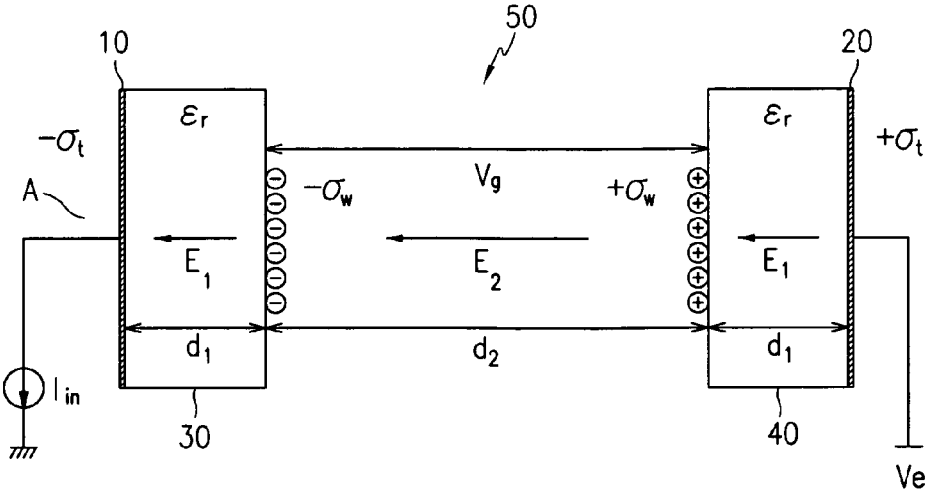
FIG. 4C shows a case when no discharge occurs in the discharge cell of FIG. 4A.
Figure 4D:
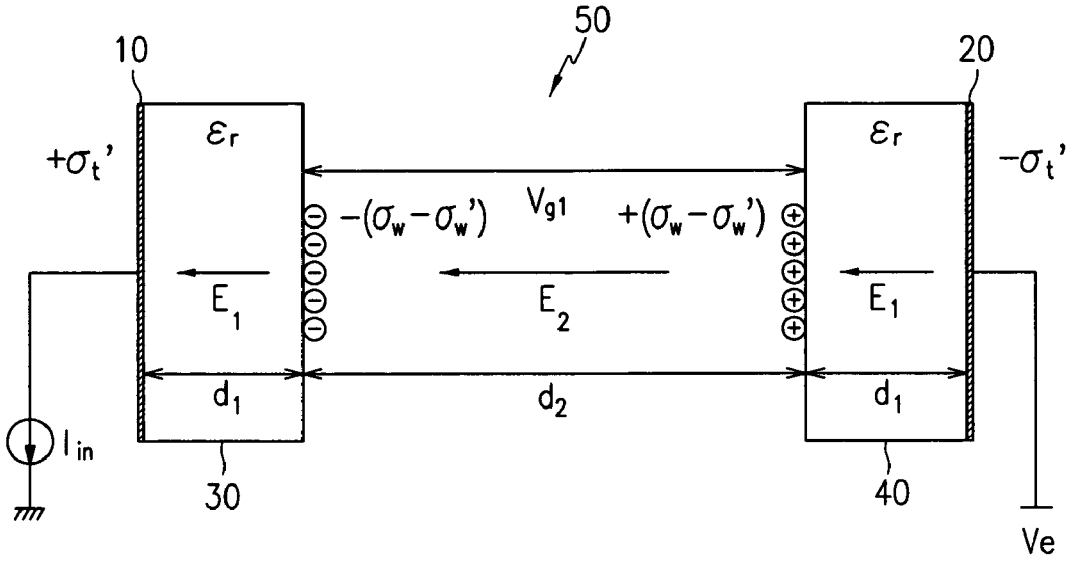
FIG. 4D shows a state where a voltage is applied when a discharge occurs in the discharge cell of FIG. 4A.
Figure 4E:
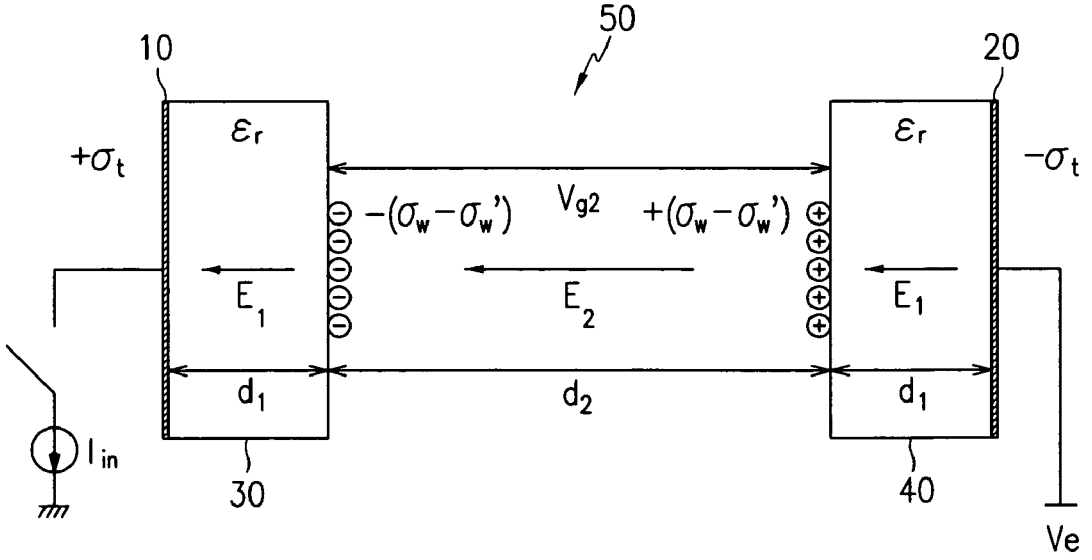
FIG. 4E shows a floated state when a discharge occurs in the discharge cell of FIG. 4A.

Referring to FIGS. 4A, 4B, 4C, 4D and 4E, the strong discharge quenching caused by floating will be described below in detail with reference to the X and Y electrodes in the discharge cell, since the discharge generally occurs between the X and Y electrodes. FIG. 4A shows a modeled diagram of a discharge cell formed by a sustain electrode and a scan electrode. FIG. 4B shows an equivalent circuit of FIG. 4A. FIG. 4C shows a case when no discharge occurs in the discharge cell of FIG. 4A. FIG. 4D shows a state in which a voltage is applied when a discharge occurs in the discharge cell of FIG. 4A, and FIG. 4E shows a floated state when a discharge occurs in the discharge cell of FIG. 4A. For ease of description, charges $-\sigma_w$ and $+\sigma_w$ are respectively formed at the Y and X electrodes 10 and 20 in the earlier stage in FIG. 4A. The charges are formed on a dielectric layer of an electrode, but for ease of explanation, it is described that the charges are formed at the electrode.

As shown in FIG. 4A, the Y electrode 10 is coupled to a current source in through a switch SW. The X electrode 20 is coupled to the voltage of Ve. Dielectric layers 30 and 40 are respectively formed within the Y and X electrodes 10 and 20, respectively. Discharge gas (not illustrated) is injected between the dielectric layers 30 and 40, and the area provided between the dielectric layers 30 and 40 forms a discharge space 50.

Since the Y and X electrodes 10 and 20, the dielectric layers 30 and 40, and the discharge space 50 form a capacitive load, they can be characterized as a panel capacitor Cp, as shown in FIG. 4B. The dielectric constant of the dielectric layers 30 and 40 is $\in_r$, the voltage at the discharge space 50 is Vg, the thickness of the dielectric layers 30 and 40 are both d1, and the distance of the discharge space between the dielectric layers 30 and 40 is d2.

The voltage of Vy applied to the Y electrode of the panel capacitor Cp is reduced in proportion to the time switch SW is turned on, as provided in Equation 1. Furthermore, when switch SW is turned on, a falling voltage is applied to the Y electrode 10.

$$Vy = Vy(0) - \frac{I_{in}}{C_p}t \qquad \text{Equation 1}$$

where Vy(0) is a Y electrode voltage Vy when the switch SW is turned on, and Cp is capacitance of the panel capacitance Cp.

Referring to FIG. 4C, the voltage Vg applied to the discharge space 50 is calculated when no discharge occurs and the switch SW is turned on, assuming the voltage applied to the Y electrode 10 is Vin.

When the voltage Vin is applied to the Y electrode 10, the charges $-\sigma_t$ are applied to the Y electrode 10, and the charges $+\sigma_t$ are applied to the X electrode 20. Using the Gaussian theorem, the electric field E1 within the dielectric layers 30 and 40 and the electric field E2 within the discharge space 50 are given as Equations 2 and 3.

$$E_1 = \frac{\sigma_t}{\varepsilon_r \varepsilon_0} \qquad \text{Equation 2}$$

where $\sigma_t$ is the charge applied to the Y and X electrodes, and $\in_0$ is a permittivity within the discharge space.

$$E_2 = \frac{\sigma_t + \sigma_w}{\varepsilon_0} \quad \text{Equation 3}$$

The external voltage (Ve−Vin) is calculated in Equation 4 according to a relation between the electric field and the distance. The voltage Vg of the discharge space 50 is calculated in Equation 5.

$$2d_1E_1+d_2E_2=V_e-V_{in} \quad \text{Equation 4}$$

$$V_g=d_2E_2 \quad \text{Equation 5}$$

From Equations 2 through 5, the charges $\sigma_t$ applied to the X or Y electrode 10 or 20 and the voltage Vg within the discharge space 50 are respectively calculated in Equations 6 and 7.

$$\sigma_t = \frac{V_e - V_{\text{in}} - \frac{d_2}{\varepsilon_0}\sigma_w}{\frac{d_2}{\varepsilon_0} + \frac{2d_1}{\varepsilon_r\varepsilon_0}} = \frac{V_e - V_{\text{in}} - V_w}{\frac{d_2}{\varepsilon_0} + \frac{2d_1}{\varepsilon_r\varepsilon_0}} \quad \text{Equation 6}$$

where Vw is a voltage formed by the wall charges $\sigma_w$ in the discharge space 50.

$$V_g = \frac{\varepsilon_r d_2}{\varepsilon_r d_2 + 2d_1}(V_e - V_{\text{in}} - V_w) + V_w = \alpha(V_e - V_{\text{in}}) + (1-\alpha)V_w \quad \text{Equation 7}$$

Since the internal length d2 within the discharge space 50 is a very large value compared to the thickness d1 of the dielectric layers 30 and 40, α almost reaches 1. Equation 7 shows that the externally applied voltage of (Ve−Vin) is applied to the discharge space 50.

Referring to FIG. 4(*d*), voltage Vg1 is calculated within the discharge space 50, when the wall charges formed at the Y and X electrodes 10 and 20 are quenched by the amount of $\sigma_w'$ and the discharge from the externally applied voltage of (Ve−Vin). Charges applied to the Y and X electrodes 10 and 20 are increased to $\sigma_t'$ since the charges are supplied from the power Vin so as to maintain the potential of the electrodes when the wall charges are formed.

Applying the Gaussian theorem in regard to FIG. 4D, the electric field E1 within the dielectric layers 30 and 40 and the electric field E2 within the discharge space 50 are calculated by Equation 8 and 9.

$$E_1 = \frac{\sigma_t'}{\varepsilon_r\varepsilon_0} \quad \text{Equation 8}$$

$$E_2 = \frac{\sigma_t' + \sigma_w - \sigma_w'}{\varepsilon_0} \quad \text{Equation 9}$$

From Equations 8 and 9, the charges $\sigma_t'$ applied to the Y and X electrodes 10 and 20 and the voltage Vg1 within the discharge space are calculated in Equations 10 and 11.

$$\sigma_t' = \frac{V_e - V_{\text{in}} - \frac{d_2}{\varepsilon_0}(\sigma_w - \sigma_w')}{\frac{d_2}{\varepsilon_0} + \frac{2d_1}{\varepsilon_r\varepsilon_0}} = \frac{V_e - V_{\text{in}} - V_w + \frac{d_2}{\varepsilon_0}\sigma_w'}{\frac{d_2}{\varepsilon_0} + \frac{2d_1}{\varepsilon_r\varepsilon_0}} \quad \text{Equation 10}$$

$$V_{g1} = d_2E_2 = \alpha(V_e - V_{\text{in}}) + (1-\alpha)V_w - (1-\alpha)\frac{d_2}{\varepsilon_0}\sigma_w' \quad \text{Equation 11}$$

Since α is almost 1 in Equation 11, very little voltage falling is generated within the discharge space 50 when the voltage Vin is externally applied to generate a discharge. Therefore, when the amount $\sigma_w'$ of the wall charges quenched by the discharge is very large, the voltage Vg1 within the discharge space 50 is reduced, and the discharge is quenched.

Next, referring to FIG. 4E, the voltage Vg2 is calculated, within the discharge space 50 when the switch SW is turned off (i.e., the discharge space 50 is floated) after the wall charges formed at the Y and X electrodes 10 and 20 are quenched by the amount of $\sigma_w'$ because of the discharge caused by the externally applied voltage Vin. Since no external charges are applied, the charges applied to the Y and X electrodes 10 and 20 become $\sigma_t$ in the same manner of FIG. 4(*c*). By applying the Gaussian theorem, the electric field E1 within the dielectric layers 30 and 40 and the electric field E2 within the discharge space 50 are given as Equation 2 and 12.

$$E_2 = \frac{\sigma_t + \sigma_w - \sigma_w'}{\varepsilon_0} \quad \text{Equation 12}$$

From Equations 12 and 6, the voltage Vg2 of the discharge space 50 is given as Equation 13.

$$V_{g2} = d_2E_2 = \alpha(V_e - V_{\text{in}}) + (1-\alpha)V_w - \frac{d_2}{\varepsilon_0}\sigma_w' \quad \text{Equation 13}$$

Equation 13 provides that a large falling voltage is generated by the quenched wall charges when the switch SW is turned off (floated). Equations 12 and 13 demonstrate that the voltage falling intensity caused by the wall charges in the floated state of the electrode becomes larger by a multiple of 1/(1−α) times than that of the voltage applied state. Since the voltage within the discharge space 50 is substantially reduced in the floated state when a small amount of charges are quenched, the voltage between the electrodes becomes below the discharge firing voltage, and the discharge is steeply quenched. The operation of floating the electrode after the discharge starts functions as a steep discharge quenching mechanism. When the voltage within the discharge space 50 is reduced, the voltage Vy at the floated Y electrode is increased by a predetermined voltage, as shown in FIGS. 3(*a*) and 3(*b*), since the X electrode is fixed at the voltage of Ve.

Referring to FIGS. 3A and 3B, when the Y electrode is floated and the Y electrode voltage falls to cause a discharge, the discharge is quenched while the wall charges formed at the Y and X electrodes are a little quenched, according to the discharge quenching mechanism. By repeating this operation, the wall charges formed at the Y and X electrodes are erased step by step to thereby control the wall charges and reach a desired state. Thus, the wall charges are accurately controlled to achieve a desired wall charge state in the falling ramp period Pr3 of the reset period Pr.

The preferred embodiment of the present invention is described during the falling ramp period Pr3 of the reset period Pr, but without being restricted to this, the preferred embodiment is applicable to cases of controlling the wall charges by using the falling ramp waveform, and it is also applicable to cases of controlling the wall charges by using the rising ramp waveform.

Figure 5A:
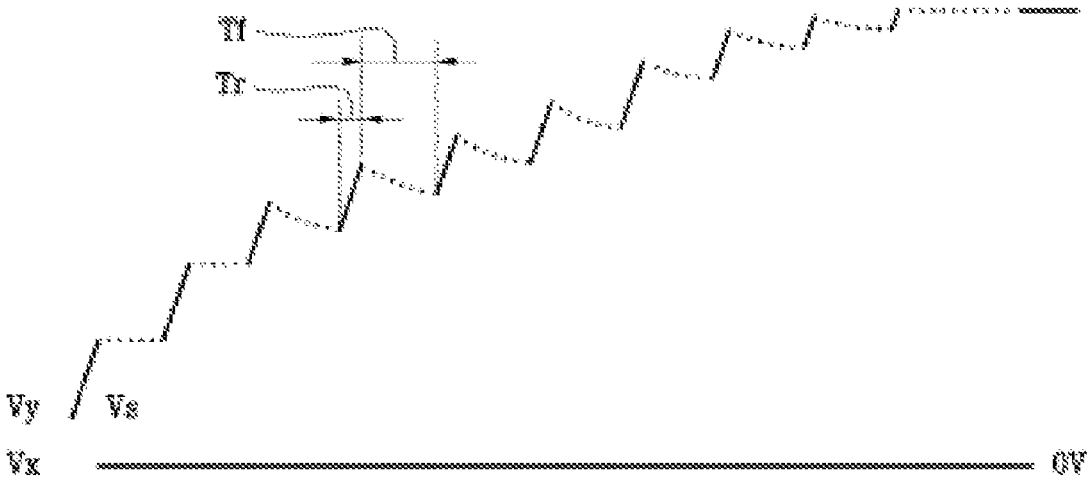
FIGS. 5A and 5B show rising ramp waveforms of floating times in accordance with a preferred embodiment of the present invention.
Figure 5B:
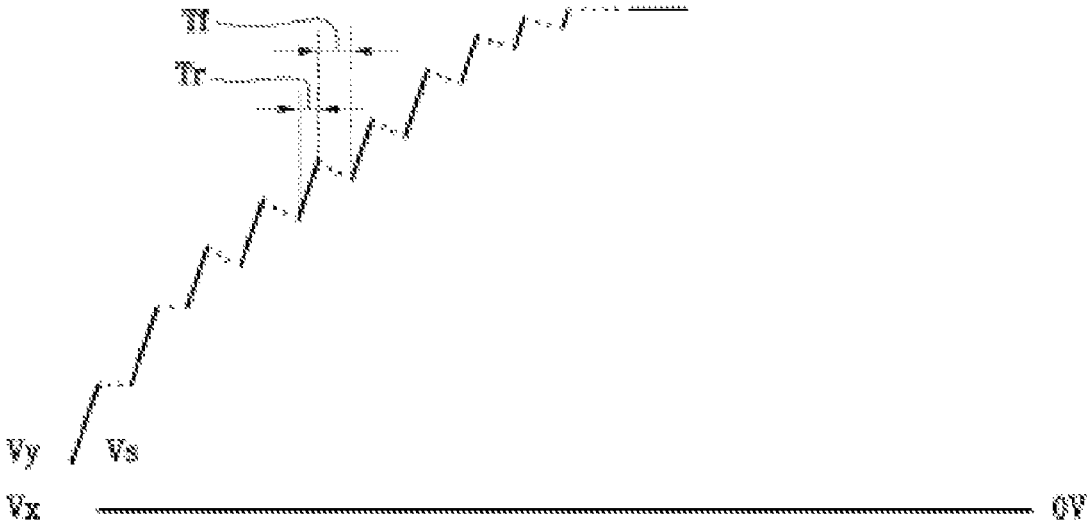

Referring to FIG. 5, a case of applying a floating method during the rising ramp period Pr2 will be described. FIGS. 5A and 5B show a rising ramp waveform and a discharge current according to a preferred embodiment of the present invention. As shown in FIGS. 2, 5A and 5B, a rising/floating voltage for repeating an increase of the voltage from Vs to Vset by a predetermined voltage and a float of the Y electrode can be applied to the Y electrode, while the X electrode is maintained at 0V in the rising ramp period Pr2 of the reset period Pr. The voltage applied to the Y electrode is quickly increased by a predetermined amount during the period of Tr, and the voltage applied to the Y electrode is stopped during the period of Tf to float the Y electrode, and the periods of Tr and Tf are repeated.

When the voltage difference between Vy at the Y electrode and Vx at the X electrode becomes greater than the discharge firing voltage Vf, while the periods Tr and Tf are repeated, a discharge between the X and Y electrodes is generated. When the Y electrode is floated after the discharge between the X and Y electrodes fires, the voltage within the discharge space is substantially reduced, and a strong discharge quenching occurs in the discharge space. Positive charges are formed at the X electrode, and negative charges are formed at the Y electrode, due to the discharge between the X and Y electrodes. The voltage Vy at the floated Y electrode is reduced by a predetermined voltage since the voltage within the discharge space is reduced as described above.

When the rising voltage is applied to the Y electrode to form a discharge and the Y electrode is floated, wall charges are formed and a strong discharge quenching is generated within the discharge space. When the applying of the rising voltage and the floating are repeated a predetermined number of times, desired amounts of wall charges are formed at the X and Y electrodes. It is desirable for the period Tr of applying the rising voltage to be short, so as to appropriately control the wall charges.

The floating time is controlled based on the number of sustain pulses of the previous subfield. FIG. 5A shows a case where less priming particles are provided due to the small number of the sustain pulses of the previous subfield. The floating time must be increased to fluently perform the reset operation. FIG. 5B shows a case where many priming particles are provided due to the large number of the sustain pulses of the previous subfield, and the reset operation functions well when the floating time is reduced.

According to the preferred embodiment of the present invention, the voltage is applied, the floating time is determined according to the number of sustain pulses of the previous subfield, and the floating operation is repeated in the rising or falling ramp waveform, thereby reducing the reset period, and appropriately controlling the wall charges.

The method of floating the scan electrodes is described in the preferred embodiment, and in addition, and the preferred embodiment can also be applied to methods of floating at least one of the scan electrode, the sustain electrode, and the address electrode in the discharge cell.

The time allocated to the reset period is reduced by determining the floating time according to the number of sustain pulses of the previous subfield and controlling the gradient of the reset signal.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A plasma display panel (PDP) for generating input video signals into a plurality of subfields, and for dividing each subfield into a reset period, an address period, and a sustain period, the PDP comprising:

an address electrode;

a scan electrode;

a sustain electrode arranged in a pair with the scan electrode;

a controller for generating subfield data and sustain pulse information and outputting a floating control signal for controlling a floating time of the scan electrode according to the sustain pulse information; and a driver for applying a voltage that corresponds to subfield data of the address electrode, applying a voltage to the sustain electrode and the scan electrode according to sustain pulse information, and floating the scan electrode according to the floating control signal, wherein the controller controls the floating time to be reduced when a number of sustain pulses of a previous subfield is increased, and wherein the driver drives the scan electrode so that floating the scan electrode during the floating time after changing a voltage of the scan electrode is repeated a predetermined number of times in the reset period.

2. The PDP of claim 1, wherein the controller comprises:

an automatic power controller for outputting power control data to control power according to a load ratio of a video signal;

a subfield generator for generating the power control data into subfields, and outputting the sustain pulse information for each subfield;

a subfield data generator for generating video signals into the subfield data that corresponds to the subfields and outputting the subfield data;

a memory for storing the sustain pulse information and a floating time that corresponds to the sustain pulse information; and a floating controller for referring to the memory and outputting the floating control signal to the driver to control the floating by using the floating time that corresponds to sustain pulse information of a previous subfield.

3. The PDP of claim 1, wherein the floating time is greater than a period for changing the voltage of the scan electrode.

4. A plasma display panel (PDP) for generating input video signals into a plurality of subfields, dividing each subfield into a reset period, an address period, and a sustain period according to sustain information, and driving the subfield, said plasma display panel comprising:

a first electrode;

a second electrode;

a first space defined by the first electrode and the second electrode; and a driving circuit, wherein the driving circuit transmits a driving signal to the first electrode and the second electrode during the reset period, and repeats an operation a predetermined number of times in the reset period, the operation being floating the first electrode during a floating period after changing a voltage of the first electrode, and wherein the floating period corresponds to sustain information of a previous subfield, and the driving circuit reduces the floating period when a number of sustain pulses of the previous subfield is increased.

5. The PDP of claim 4, wherein the first electrode is a scan electrode and the second electrode is a sustain electrode.

6. The PDP of claim 4, wherein the floating period is greater than a period for changing the voltage of the first electrode.

7. A method for driving a plasma display panel (PDP) including a first space defined by a first electrode and a second electrode and a driving circuit for driving the first space by sustain pulses, said method comprising:

changing a voltage of the first electrode to discharge the first space; and floating the first electrode for a floating period that corresponds to a number of sustain pulses of a previous subfield, after changing the voltage of the first electrode, wherein floating the first electrode during the floating period after changing the voltage of the first electrode is repeated a predetermined number of times in a reset period of each subfield, and wherein the floating period is reduced when the number of sustain pulses of the previous subfield is increased.

8. The method of claim 7, wherein the first electrode is a scan electrode and the second electrode is a sustain electrode, and the sustain electrode is biased at a constant voltage.

9. The method of claim 7, wherein the floating period is longer than a period for changing the voltage of the first electrode.

* * * * *